United States Patent [19]

Yan et al.

[11] 4,351,566

[45] Sep. 28, 1982

[54] METHOD AND APPARATUS FOR MIXING GASEOUS OXIDANT AND LIXIVIANT IN AN IN SITU LEACH OPERATION

[75] Inventors: Tsoung-yuan Yan, Philadelphia, Pa.; Wilton F. Espenscheid, Princeton, N.J.

[73] Assignee: Mobil Oil Corporation, New York, N.Y.

[21] Appl. No.: 846,863

[22] Filed: Oct. 31, 1977

[51] Int. Cl.[3] ..... E21B 43/28

[52] U.S. Cl. ..... 299/5; 261/74

[58] Field of Search ..... 299/4, 5; 166/315; 261/74, 64 D, 115, 95, 124

[56] References Cited

U.S. PATENT DOCUMENTS

| | | | |
|---|---|---|---|
| 3,640,579 | 2/1972 | Lewis | 299/4 |
| 3,928,199 | 12/1975 | Kirk | 261/114 R |
| 4,045,084 | 8/1977 | Hsueh et al. | 299/4 |
| 4,066,297 | 1/1978 | Spence | 299/4 |

*Primary Examiner*—William F. Pate, III

*Attorney, Agent, or Firm*—Charles A. Huggett; James F. Powers, Jr.; John K. AboKhair

[57] ABSTRACT

Method and apparatus for mixing a gaseous oxidant (e.g., oxygen) and a lixiviant (e.g., an aqueous carbonate solution) at a downhole location in a well before the oxygen-saturated lixiviant is injected into a formation to be leached. The invention involves establishing a mixing zone in the well by positioning an orifice plate in the well at the downhole location. Lixiviant as it is flowed down the well passes through a restrictive opening in the plate causing a substantial increase in the flow velocity of the lixiviant. At the same time, gaseous oxidant is supplied to a point adjacent the opening in the plate and due to the increased velocity of the lixiviant flowing through the orifice, the oxidant is trapped to form a gas pocket below the orifice. Lixiviant flows through the gas pocket and becomes saturated with the gaseous oxidant.

15 Claims, 3 Drawing Figures

METHOD AND APPARATUS FOR MIXING GASEOUS OXIDANT AND LIXIVIANT IN AN IN SITU LEACH OPERATION

BACKGROUND OF THE INVENTION

The present invention relates to the in situ leaching of mineral values and more particularly relates to a method and apparatus for mixing a gaseous oxidant and a lixiviant at a downhole location for use in an in situ leach operation.

In a typical in situ leach operation, wells are completed into a leachable mineral-bearing formation and a lixiviant is flowed between wells to dissolve the mineral values into the lixiviant. The pregnant lixiviant is produced to the surface where it is treated to recover the mineral values from the lixiviant.

Many leachable mineral values, as they occur in their natural state in a formation, must be oxidized to a higher valence before they become soluble into a lixiviant. For example, uranium is normally present in a formation in the tetravalent state and must be oxidized to the hexavalent state to render it soluble in a suitable lixiviant, e.g., an aqueous carbonate solution. To oxidize uranium to its higher valence, it is customary to contact the uranium in the formation with an oxidant which may be injected directly into the deposit or which may be mixed into the leach solution and injected therewith.

Several oxidants have been proposed for this purpose, including gaseous oxidants such as air and oxygen. For example, in U.S. Pat. No. 3,708,206, oxygen is injected into a formation prior to or simultaneously with a lixiviant. In U.S. Pat. No. 3,713,698, air is injected through a production well to oxidize uranium values prior to injecting a lixiviant through an injection well. In both U.S. Pat. Nos. 3,640,579 and 3,860,289, oxygen is supplied through a tube to a downhole location where it is bubbled into a lixiviant before the lixiviant is injected into a formation.

With each of these types of injection schemes, excess quantities of oxygen are required to dissolve a sufficient amount of oxygen into the leach solution. For example, where oxygen is merely bubbled into the lixiviant downhole before the lixiviant enters the formation, experimentation suggests that a tenfold to fiftyfold excess of oxygen over the saturation requirement is needed to bring the leach solution to a level of 80% oxygen saturation, resulting in excessive oxygen costs. Of course, this excess oxygen could be collected, recompressed, and recycled; but the cost of doing this is equally as excessive.

Another approach to mixing oxygen and lixiviant downhole might be to use a mechanical agitator (beater) downhole. However, the high capital investment, along with operational and maintenance costs, makes such an approach impractical. Still another mixing approach is to inject oxygen through fine frits or spargers located downhole to form small bubbles in the lixiviant to effect a good mass transfer of oxygen to the lixiviant. However, based on known in situ leach conditions, precipitates present in normal leach operations will likely plug the frits quickly thereby severely restricting the necessary oxygen flow.

Therefore, for a method of mixing the gaseous oxidant and the lixiviant together at a downhole location to be economical and operationally functional, it should involve apparatus which (1) is not easily susceptible to plugging, either by materials carried in the lixiviant or by precipitates resulting from chemical reactions of the oxidant with materials in the lixiviant; (2) is effectively self-controlling, i.e., one not requiring complex controls at either the surface or downhole; (3) requires little or no excess oxidant to fully saturate the lixiviant; and (4) requires no additional energy sources such as power for motor-driven downhole mixers or the like. At the same time, the mixing method and apparatus should provide for a high rate of mass transfer of oxidant to the lixiviant, prevent substantial amounts of oxidant from bubbling to the surface, and restrict the amount of undissolved oxidant in the lixiviant before it enters the formation to be leached.

SUMMARY OF THE INVENTION

The present invention provides a method and apparatus for mixing a gas and a liquid at a downhole location in a well to saturate the liquid with gas without requiring any substantial amount of excess gas. More specifically, in the present invention, a mixing zone is established in an injection well of an in situ leach operation wherein a lixiviant, e.g., an aqueous carbonate solution, is saturated with a gaseous oxidant, e.g., oxygen, before the lixiviant is injected into the formation to be leached. An orifice plate having a restricted opening therethrough is placed downhole at the mixing zone and is positioned so that the lixiviant flowing down in the well will have to pass through the opening in the plate. A conduit for supplying the gaseous oxidant extends from the surface and terminates adjacent the opening in the plate. Preferably, the orifice plate is attached to the lower end of the conduit so that it may be positioned and removed from the well with the conduit.

Lixiviant is flowed down the annulus formed between the wall of the well and the oxidant conduit to the orifice plate where it flows through the opening therein, thereby substantially increasing its flow velocity. At the same time, gaseous oxidant is fed down the conduit and exits slightly below the orifice in the form of tiny bubbles. The increased velocity of the lixiviant at that point increases the drag force on the bubbles as they attempt to rise in the lixiviant and the pressure drop across the orifice reduces the effective buoyant force of the bubbles in the lixiviant. Together, these effects prevent the bubbles from passing upward through the orifice plate causing the bubbles to be trapped to form an oxidant pocket in the mixing zone below the orifice plate.

Working on the principle similar to that of a venturi scrubber or mixer, the lixiviant or liquid flows through the oxidant pocket in the form of a "waterfall" with oxidant or gas bubbles becoming entrapped therein. Part of the gas is dissolved into the liquid as the bubbles are formed, with some free gas being carried from the pocket by the liquid. A column of froth is created in the mixing zone by the "waterfall" as it exits the gas pocket. This froth column provides extremely high interfacial surface area and liquid turbulence thereby further promoting mass transfer of additional gas to the liquid.

The present mixing system is stable as long as the gaseous oxidant is fed at a rate equal or below that required to saturate the lixiviant. In many actual leach operations, 75% to 80% saturation will be adequate. In the present invention, when excess oxidant is fed to the system, pressure builds up in the well which causes a reduction in the lixiviant flow rate. This, in turn, permits excess oxidant from the mixing zone to bubble to the surface where it can be vented. Also, the increased pressure in the well, temporarily reduces oxidant flow to bring the system back into balance.

BRIEF DESCRIPTION OF THE DRAWINGS

The actual operation and the apparent advantages of the invention will be better understood by referring to the drawings in which like numerals identify like parts and in which.

DESCRIPTION OF THE PREFERRED EMBODIMENT

Figure 1:
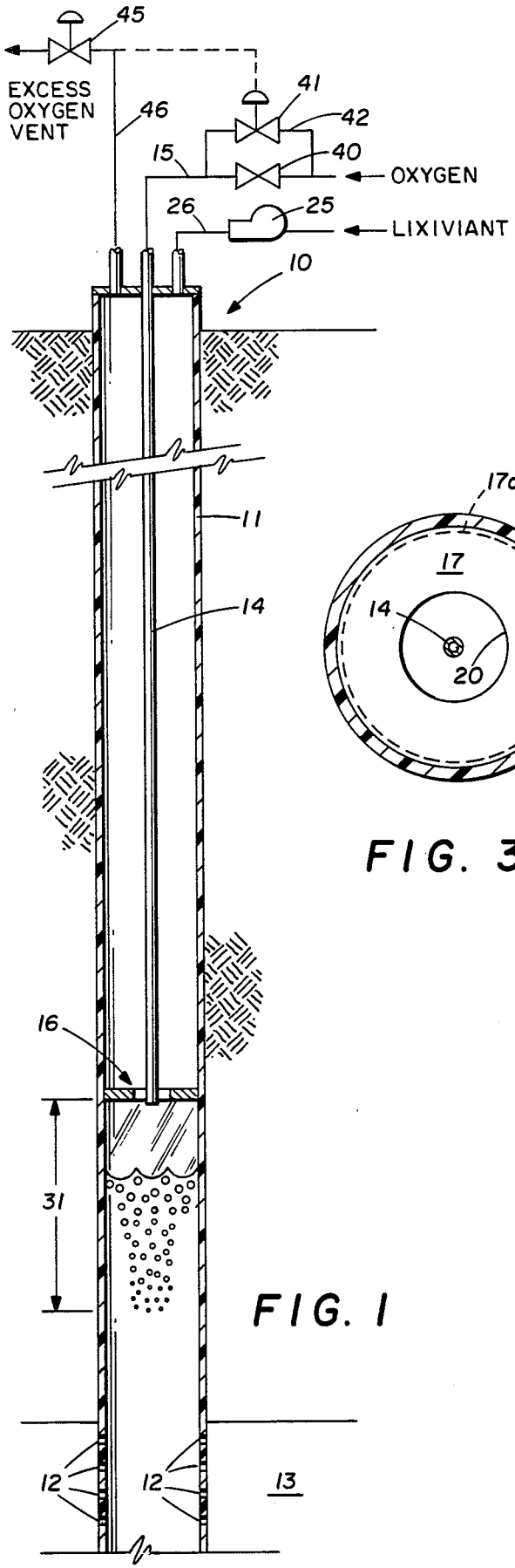
FIG. 1 is an elevational view, partly in section, of the present invention in position in a well.

Referring more particularly to the drawings, FIG. 1 discloses an injection well which is used to inject a lixiviant, e.g., an aqueous carbonate solution, in an in situ mineral leach operation, e.g., recovery of uranium. Well 10 is completed in a known manner with a casing 11 of polyvinyl chloride pipe or the like. Perforations 12 are provided through casing 11 adjacent the formation 13 to be leached to allow lixiviant to flow from casing 11 into formation 13. Although perforations 13 are shown for illustration, the interval of well 10 adjacent formation 13 could be completed with screen or slotted liners as is well known in the art.

Conduit 14 is adapted to be connected to line 15 which in turn is connected to a source of gaseous oxidant, e.g., oxygen. Conduit 14 extends from the surface to a point slightly above perforations 12. Mixing means 16 is positioned near the lower end of casing 11 at substantially the same point where the lower end of conduit 14 will lie when in an operable position within the well. Although mixing means 16 could be attached to casing 11 before the casing is run into the well or otherwise positioned, it is preferably attached directly to conduit 14 so that mixing means 16 can be properly positioned relative to conduit 14 and can be placed and removed from well 10 with conduit 14 when desired.

Figure 3:
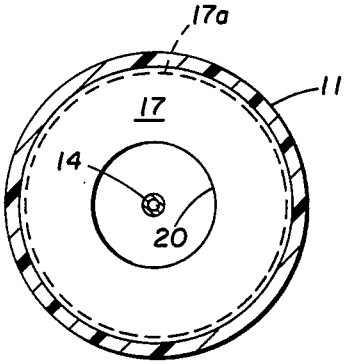
FIG. 3 is a sectional view taken along sectional line 3–3 of FIG. 2.
Figure 2:
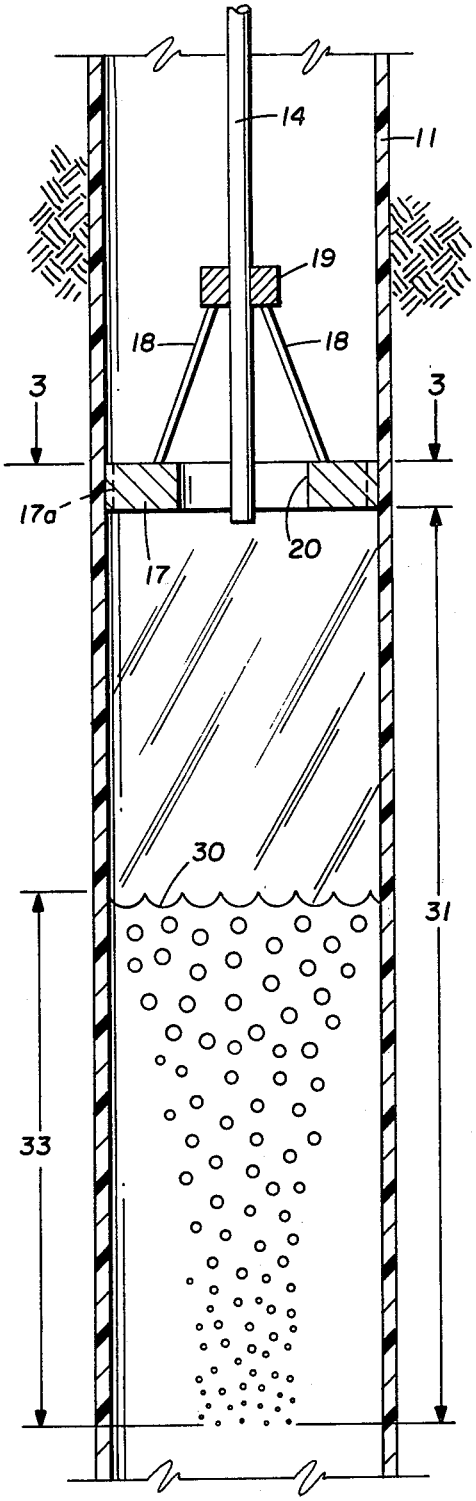
FIG. 2 is an enlarged sectional view of the lower end of the well in FIG. 1.

Referring to FIGS. 2 and 3, mixing means 16 is comprised of orifice plate 17 secured to conduit 14 by means of brace members 18 and collar 19 which, in turn, is attached to conduit 14 by set screws, brazing, or other similarly known technique. Preferably, orifice plate 17 is sized so that a small gap 17*a* (shown by dotted lines in FIGS. 2 and 3) exists between the inner wall of casing 11 and plate 17 when mixing means 16 is in an operable position. Gap 17*a* is small enough (e.g., one-eighth inch gap in a four inch casing) so that orifice plate 17 forms an effectively tight fit with the inner wall of casing 11 to minimize flow between the two under normal operating conditions. Plate 17 has a central restrictive opening 20 therethrough. The lower end of conduit 14 terminates adjacent opening 20, preferably just slightly below the lower surface of orifice plate 17.

In operation, mixing means 16 is attached to conduit 14 and is lowered into well 10 to a point slightly above (e.g., 30 to 50 feet) perforations 12 which, in turn, lie adjacent formation 13 to be leached. Lixiviant, e.g., a carbonate solution such as a solution containing water and carbon dioxide, is pumped by a centrifugal pump 25 or the like through line 26, into the annulus formed between conduit 14 and casing 11. Lixiviant flows into mixing zone 31 through the restriction formed by central opening 20 in the orifice plate 17 thereby substantially increasing the flow velocity of the lixiviant at that point.

Meanwhile, gaseous oxidant, e.g., oxygen, is simultaneously flowed to mixing zone 31 through conduit 14 and exits in the form of bubbles into the stream of the lixiviant just below central opening 20 in orifice plate 17. Due to the increased flow velocity of the lixiviant as it passes through opening 20, the drag force on the oxygen bubbles is increased as they attempt to rise in the lixiviant. Further, the pressure drop across plate 17 decreases the effective buoyant force of the oxygen bubbles in the lixiviant. Together, these effects prevent the bubbles from passing upward through plate 17 and are trapped to form an oxygen pocket 30 in mixing zone 31 below plate 17.

The lixiviant flows through plate 17 and oxygen pocket 30 in the form of a high velocity "waterfall" with oxygen bubbles becoming entrapped therein. Part of this oxygen is dissolved into the lixiviant as the bubbles are formed and the remaining oxygen in the lixiviant is carried down by the "waterfall" through and out of oxygen pocket 30. A column of froth 33 is formed by the impact of the lixiviant falling on the surface below oxygen pocket 30 and creates an area of extremely high interfacial surface area and liquid (lixiviant) turbulence, thereby further promoting mass transfer of oxygen to the lixiviant to fully saturate same.

To insure formation of oxygen pocket 30, the lixiviant flow rate at orifice plate 17 must exceed a certain critical, minimum, linear flow velocity which depends on the configuration of opening 20 in plate 17. This minimum flow velocity is a linear function of the ratio of cross-sectional areas of opening 20 and casing 11 and can be expressed as follows:

$$V_{min}=k^{A}o/A_p$$

where:

$V_{min}$ = minimum linear flow velocity of lixiviant in casing 11 in meters per minute $A_o$ = cross-sectional area of opening 20

$A_p$ = cross-sectional area of casing 11 k = predetermined constant derived from experiment where $V_{min}$, $A_o$, and $A_p$ are known. For the designed capacity, $V_{min}$ can be calculated, from which the $A_o/A_p$ ratio can be obtained from the equation above. Of course, if either the cross-sectional area of conduit 14 or gap 17*a* are too large, they will have to be taken into consideration in the above equation since they obviously change $A_o$. Therefore, the diameter of conduit 14, and the gap 17*a* should be as small as is practical in a particular operation. The workable ratio of $A_o$ to the annual area of gap 17*a* is 2 or greater.

When the lixiviant flow-velocity is higher than the minimum value shown above, all of the oxygen injected is carried down and is dissolved into the lixiviant. The oxygen mass-transfer is highly effective, bringing the lixiviant to saturation when enough oxygen is flowed through conduit 14. Therefore, when the oxygen is fed at a rate equal or lower than that required for saturating the lixiviant, the operation is completely stable, i.e., the lengths of oxygen pocket 30 and froth column 33 remained constant.

However, when excess oxygen is fed to the system, both oxygen pocket 30 and froth column 33 increase in length and the pressure below orifice plate 17 increases. Since well 10 is closed at the surface, this increase in back pressure is sensed at the surface by centrifugal pump 25 which is very sensitive to the liquid head being pumped against. This causes the lixiviant flow rate to decrease so that eventually big bubbles of oxygen begin to break through the gap 17*a* between orifice plate 17 and casing 11 and rise upward in the lixiviant to the surface.

The main supply of oxygen is manually regulated through valve 40 in line 45 while additional oxygen is furnished through a solenoid-operated valve 41 in bypass line 42 to precisely control the amount of oxygen being fed into well 10. When excess oxygen accumulates at the top of well 10 as described above, pressure relief valve 45 in vent line 46 opens to vent the excess oxygen from well 10. At the same time, the pressure in line 46 actuates solenoid-operated valve 41 to reduce the supply of oxygen to line 14, thereby bringing the system back into balance. Therefore, although some undissolved oxygen may be forced into the formation if oxygen pocket 30 and froth column 33 grow too large, the operation of the present invention is basically safe and self-regulating, even when excess oxygen is inadvertently supplied to well 10.

We claim:

1. A method of mixing a gaseous oxidant and a lixiviant at a downhole location within a well, said method comprising:

supplying said gaseous oxidant to a mixing zone near the lower end of said injection well;

trapping said gaseous oxidant within said mixing zone;

passing said lixiviant through said trapped gaseous oxidant within said mixing zone to mix said gaseous oxidant and said lixiviant; and increasing the velocity of said lixiviant as it enters said mixing zone just prior to being passed through said trapped gaseous oxidant.

2. The method of claim 1 including:

controlling the supply of said gaseous oxidant to said mixing zone to maintain the volume of said trapped gaseous oxidant substantially constant.

3. The method of claim 2 wherein said lixiviant comprises;

an aqueous carbonate solution; and wherein said gaseous oxidant comprises;

oxygen.

4. The method of claim 3 wherein said step of controlling said gaseous oxidant supply comprises:

decreasing the flow of said gaseous oxidant to said mixing zone in response to an increase in pressure within said well.

5. The method of claim 4 including:

venting excess oxygen that accumulates in said well.

6. A method of mixing a gaseous oxidant and a lixiviant at a downhole location within a well, said method comprising:

positioning a mixing means having a restrictive opening therethrough at said downhole location within said well;

flowing lixiviant down said well and through said restrictive opening in said mixing means; and simultaneously supplying gaseous oxidant downhole to said restrictive opening in said mixing means, where said increased flow velocity of said lixiviant as it passes through said restrictive opening increases the drag force on said gaseous oxidant and decreases the buoyant effect of the lixiviant to thereby trap said gaseous oxidant below said mixing means in a mixing zone where said oxidant becomes mixed with said lixiviant as said lixiviant flow through said trapped oxidant.

7. The method of claim 6 including:

controlling the supply of said gaseous oxidant to said mixing zone to maintain the volume of said trapped gaseous oxidant substantially constant.

8. The method of claim 7 wherein said lixiviant comprises:

an aqueous carbonate solution; and wherein said gaseous oxidant comprises:

oxygen.

9. The method of claim 8 wherein said step of controlling said gaseous oxidant supply comprises:

decreasing the flow of said gaseous oxidant to said mixing zone in response to an increase in pressure within said well.

10. The method of claim 9 including:

venting excess oxygen that accumulates in said well.

11. An apparatus for mixing a gas and a liquid at a downhole location within a well, said apparatus comprising:

a conduit adapted to be connected at its upper end to a supply of said gas;

a mixing means adapted to be positioned near the lower end of said conduit when in an operable position within said well, said mixing means comprising:

means for trapping said gas after it exits from said conduit; and means for directing said liquid being flowed down said well through the trapped gaseous oxidant.

12. An apparatus for mixing a gas and a liquid at a downhole location in a well, said apparatus comprising:

a conduit adapted to be connected at its upper end to a supply of gas;

a mixing means adapted to be positioned at the lower end of said conduit when said conduit and said mixing means are in an operable position within the well, said mixing means comprising:

an orifice element having a restrictive opening therethrough, through which said liquid must flow upon reaching said downhole location, said conduit terminating substantially within said restrictive opening of said orifice element.

13. The apparatus of claim 12 including:

means for attaching said orifice element to said conduit.

14. An apparatus for mixing a gas and a liquid at a downhole location in a well, said apparatus comprising:

an orifice means within said well at said downhole location, said orifice means having a restrictive opening therethrough positioned so that liquid flowing down said well must flow through said opening;

a conduit extending from the surface to said downhole location in said well for supplying said gas, said conduit terminating adjacent said opening in said orifice means; and means for controlling the flow of gas through said conduit in response to the pressure in said well.

15. The apparatus of claim 14 including:

means for venting excess gas from said well.

* * * * *